US005377990A

United States Patent [19]

Seeney-Sullivan

[11] Patent Number: 5,377,990

[45] Date of Patent: Jan. 3, 1995

[54] BOARD GAME INCORPORATING NATIVE AMERICAN SYMBOLS AND KNOWLEDGE

[76] Inventor: Sarah E. Seeney-Sullivan, P.O. Box 310, Cheswold, Del. 19936

[21] Appl. No.: 141,518

[22] Filed: Oct. 27, 1993

[51] Int. Cl.[6] ..... A63F 3/00; A63F 9/18

[52] U.S. Cl. ..... 273/236; 273/409; 273/344; 273/430; 273/DIG. 25

[58] Field of Search ..... 273/407–409, 273/236, 242–244, 248–254, 273, 277, 440, 429–432, 313, 314, 85 R, 344, DIG. 25

[56] References Cited

U.S. PATENT DOCUMENTS

| | | | |
|---|---|---|---|
| 3,504,913 | 4/1970 | Bilotti | 273/344 |
| 3,559,993 | 2/1971 | Thomas | 273/408 |
| 3,674,264 | 7/1972 | Boercker | 273/445 |
| 4,309,035 | 1/1982 | Goldfarb | 273/237 |
| 4,577,869 | 3/1986 | Brinkman | 273/269 |
| 4,640,513 | 2/1987 | Montijo | 273/249 |
| 4,872,681 | 10/1989 | Martin | 273/118 R |
| 4,988,108 | 1/1991 | Shepard | 273/254 |
| 5,066,020 | 11/1991 | Trudeau | 273/408 |

OTHER PUBLICATIONS

M. Y. Sports & Games Ltd. advertisement "Bullseye", 1982.

*Primary Examiner*—Benjamin H. Layno

*Attorney, Agent, or Firm*—Richard C. Litman

[57] ABSTRACT

A board game in the general form of a circular pattern of native American symbols includes a matrix of like symbols in the center. Players toss a projectile at specific symbols in the board center, attempting to hit those symbols which match those along the periphery of the board which have been assigned to each player. Successful strikes are marked with an appropriate and distinctive marker. A player continues so long as he/she successfully hits the desired symbols, up to a maximum of six. The player is then randomly rewarded with symbol cards equal to the number of successful hits, which cards are turned face up. Those that match are placed upon the player's peripheral symbols, indicating that those have been acquired by the player and need not be acquired again. Other players may claim the first player's non-matching cards if those cards match their symbols. Other players may also challenge the first player with questions which must be answered successfully before the first player can win the game.

10 Claims, 4 Drawing Sheets

BOARD GAME INCORPORATING NATIVE AMERICAN SYMBOLS AND KNOWLEDGE

FIELD OF THE INVENTION

The present invention relates generally to games, and more specifically to a board game having elements of skill, knowledge and chance and incorporating native American symbols and knowledge in the play of the game.

BACKGROUND OF THE INVENTION

As the leisure time of the average person continues to grow, more and more opportunities for entertainment have been developed. In the past, board games were relatively popular until the advent of electronic entertainment such as television. Even so, specialized board games based upon role playing or various forms of conflict are enjoying increased popularity. There are many aspects of play which simply cannot be enjoyed by means of electronic devices.

In the relatively recent past, an increasing number of people have become interested in their racial and/or ethnic heritages. In the U.S., the availability of African-American, native American, European-American, and other cultural artifacts and customs have increased steadily recently. However, while various board games have been developed relating to specialized occupations or simulating various more physical activities or games, few, if any, have been developed which relate to the racial or ethnic background of certain groups of people. This area is especially lacking in board games relating to native American peoples, particularly a game which includes elements of physical skill, knowledge and chance. As an example of the above, it is generally known that a popular game among many native American Indian tribes or groups was that of rolling a hoop (generally formed of willow or other pliable wood) along the around and attempting to toss a pole (representing a spear) through the hoop. The game was valuable for more than the mere competitive challenge among one's peers, for it simulated the climax of the hunt in which a spear is thrown at (probably running) game. A player skilled at the "hood and pole" game would likely also be a skilled hunter.

The need arises for a board game which includes elements of native American culture, and requires physical skill and knowledge of the players of the game. The game must also include an element of chance in order to broaden the possibility of winning among players having different levels of knowledge or skill. The game must be relatively simple to play, thus enabling relatively young persons to play the game and thereby passing along native American knowledge to those persons at an early age.

DESCRIPTION OF THE PRIOR ART

U.S. Pat. No. 3,674,264 issued to Ethel Boercker on Jul. 4, 1972 discloses a Matching Game Apparatus including a patterened circular game board and markers having like patterns. The markers are randomly tossed onto the board, with the object being to pick up markers resting on like patterned areas of the board as quickly as possible. No special knowledge or other skills are required, and the only chance mechanism involved is the initial toss of the markers on the board surface.

U.S. Pat. No. 4,309,035 issued to Adolph E. Goldfarb on Jan. 5, 1982 discloses an Action Game Apparatus With Rotating Disc Dispensing Unit. Each player has a set of indicia in front of him or her, and a rotating dispenser randomly ejects markers having indicia thereupon to each player station. The players must place markers with matching indicia on the appropriate space at their station or playing area; dissimilar markers are returned to the dispenser. The game is one of physical skill, rather than knowledge or chance.

U.S. Pat. No. 4,577,869 issued to Winfield L. Brinkman on Mar. 25, 1986 discloses a Promotional Game having a game card with a generally circular pattern thereon. The game is played by attempting to match cards received with indicia on the game board. No special knowledge or physical skill is required; the game is strictly a game of chance.

U.S. Pat. No. 4,640,513 issued to Robert Montijo on Feb. 3, 1987 discloses a Super Memory Educational Game Of Skill And Chance. Contrary to the title, it appears that no physical skill is required for the play of the game, the only skills mentioned being word and number skills. Moreover, the game requires a progression around the entire board until reaching the center, unlike the present game. No specific requirement of native American knowledge or lore is required, as in the present game.

Finally, U.S. Pat. No. 5,066,020 issued to Albert D. Trudeau on Nov. 19, 1991 discloses a Dart Card Game Board in which darts representing conventional playing cards are selected by a player, who then attempts to hit specific areas of the game board which are also marked to represent playing cards. No special knowledge is required, the only requirement being one of skill in tossing the darts, and no chance means is provided, assuming the player(s) is/are sufficiently skillful that chance placement of the darts is ruled out.

None of the above noted patents, taken either singly or in combination, are seen to disclose the specific arrangement of concepts disclosed by the present invention.

SUMMARY OF THE INVENTION

By the present invention, an improved board game is disclosed.

Accordingly, one of the objects of the present invention is to provide an improved board game which includes a circular representation of a hoop, into which a projectile is tossed at a specific target.

Another of the objects of the present invention is to provide an improved board game which includes elements of native American Indian knowledge and lore.

Yet another of the objects of the present invention is to provide an improved board game which requires physical skill and dexterity in order to strike precisely a desired target or mark in the center of the circle, according to like marks along the periphery of the circle assigned to a given player.

Still another of the objects of the present invention is to provide an improved board game which rewards accuracy with a symbol matching one of the symbols of the board, which symbol may or may not match the target symbol struck, thus providing an element of chance to offset the skill involved in the present game.

A further object of the present invention is to provide an improved board game which includes the asking and answering of questions pertaining to native American knowledge and lore, thus requiring such knowledge of a successful player of the present game.

A final object of the present invention is to provide an improved board game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
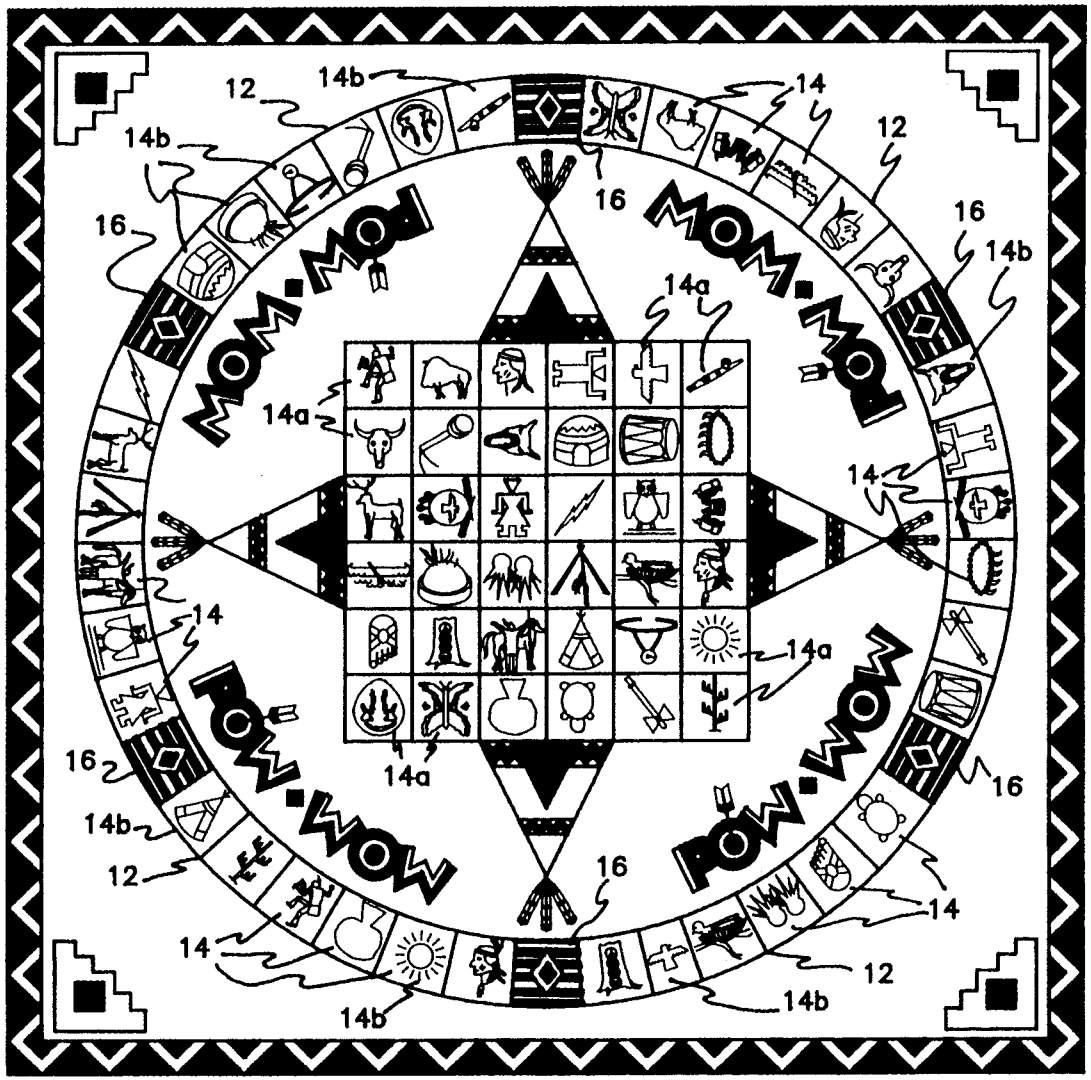
FIG. 1 is a plan view of the game board of the present invention, showing its various features.

Referring now particularly to FIG. 1 of the drawings, the present invention will be seen to relate to a board game incorporating native American skills and knowledge, and a game board 10 therefor. The game board 10 will be seen to have a periphery 12 comprising a series of native American symbols 14 thereon, and divided into a plurality of groups. Each of the groups is separated from the adjacent groups to either side by a separation sign 16. The periphery 12 is preferably circular, so as to simulate the hoop of the native American pole throwing game described above in the Background of the Invention. However, it will be seen that other shapes may be provided without affecting the play of the game as described below. The periphery and features therein may be provided on a generally rectangular game board 10, or other shape as desired.

The center of the dame board 10 within the periphery 12 includes a plurality of symbols **14*a*, with each of the symbols 14*a* matching one of the symbols 14 of the periphery 12. While no particular positional relationship is required, it will be seen that there is a one-to-one correspondence between each of the symbols 14 of the periphery 12, and the symbols 14*a* contained within the periphery 12. The game board 10 of FIG. 1 provides a series of six sets of peripheral symbols 14, with each set containing six symbols 14, resulting in a total of 36 peripheral symbols 14. The center symbols 14*a* will be seen to comprise a like total of 36 symbols, arranged in a six by six array. More or fewer symbols may be provided, so long as the center symbols 14*a* and peripheral symbols 14 are equal in number and kind. The six different sets of peripheral symbols 14 provide for up to six players, although fewer players may be accommodated by allowing some sectors of the periphery 12** and symbols to remain inactive, or for players to use more than one sector each.

Figure 5:
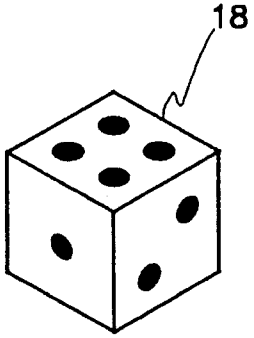
FIG. 5 is a perspective view of a single die used as a chance determination means in the present game.

As noted above, the present game may be played by up to six players. Players each determine their positions around the board 10 by choosing one of the peripheral segments bound by a separation sign at each end. In the event of three players, each of the players may choose two adjacent segments if so desired, or segments may be left unused. The order of play is determined by chance means, such as tossing the die 18 of FIG. 5; subsequent tosses determine the outcome in the event of a tie(s). The player receiving the highest number Plays first and also serves as a game manager, handling the various cards, tokens and articles which are included in the present game and which are described below. Play begins with that first player, and proceeds clockwise around the periphery of the board 10.

Figure 3:
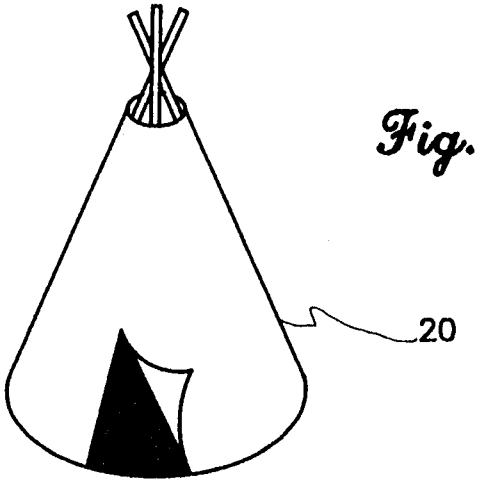
FIG. 3 is a perspective view of a position marker used in the present game.
Figure 6:
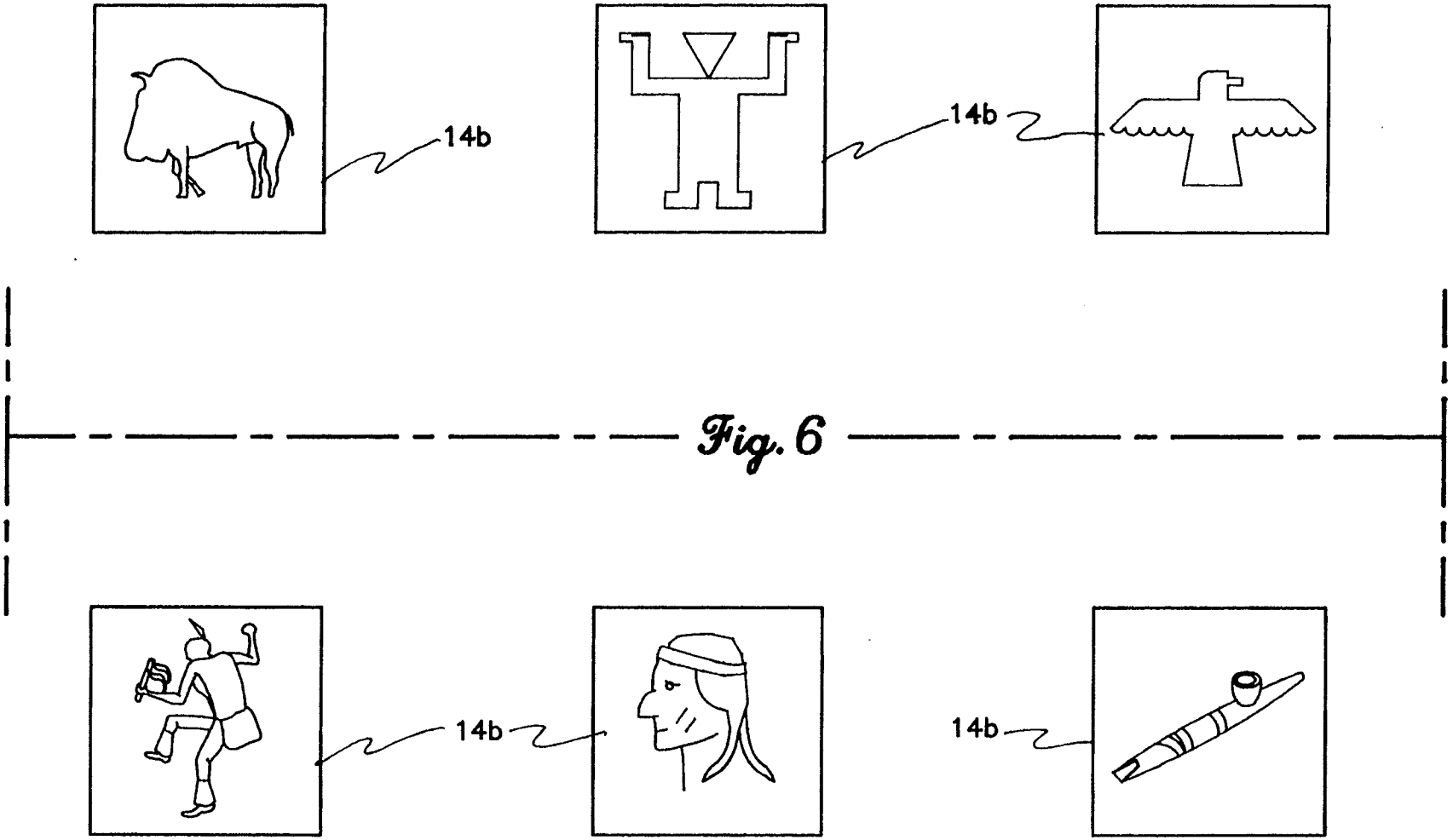
FIG. 6 is a plan view of the faces of various symbol cards used in the present game.

Each player must also select a plurality of position markers 20 (FIG. 3), corresponding to his/her player peripheral area. In the example of the present game with a total of 36 symbols in six groups of six symbols each, a total of 36 position markers 20 of six different colors/shapes/types/etc. would be provided, with each player taking a number of identical markers 20 corresponding to the number of his/her peripheral playing area and symbols. Assuming a player is responsible for six peripheral symbols 14, that player would also have six identically colored/shaped/sized position markers 20. While the markers may take on any suitable form, in keeping with the spirit of the present game the markers 20 are preferably formed to represent a symbol or artifact of native American culture, such as the teepee 20 shown in FIG. 3. The use of these markers 20 is described below.

Figure 4:
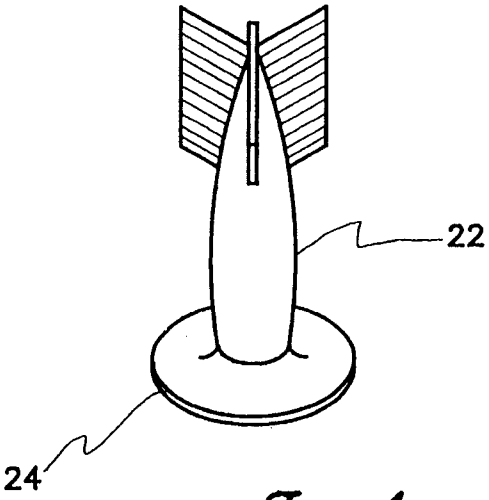
FIG. 4 is a perspective view of a projectile used during the play of the present game.

The first step in the play of the game is to attempt to strike cleanly one of the symbols **14*a* in the center area of the board 10, which corresponds to one of the peripheral symbols 14 for the player actively taking a turn. This is done by means of the projectile 22 or dart of FIG. 4. The projectile 22 preferably includes a suction cup tip 24, in order to reduce hazards among small children and to preclude damage to the board 10. The relatively blunt tip or suction cup 24 is formed to be somewhat smaller than the dimensions of each of the central symbols 14*a*, in order to provide some tolerance for tosses which are less than perfectly centered within a divan symbol 14*a* area. At this initial point in the dame, the object is for the player handling the projectile 22 to toss the projective 22 to land cleanly (i.e., without overlapping the border of the symbol 14*a* selected) on one of the central symbols 14*a* corresponding to one of the symbols 14 of that players peripheral segment. Any overlapping of an adjacent symbol area, or opponent's symbol area, is a miss and the turn ends at that point. Additional penalties for striking either partially or entirely in another player's symbol, are explained further below. This particular part of the game requires a reasonable degree of physical skill on the part of the player(s) in order to strike cleanly the symbol(s) 14*a* chosen. A clean hit allows the player to continue to toss the projectile 22 in an attempt to strike other symbols 14*a* in the center of the board 10; each clean hit allows the player to place a marker 20 upon the particular peripheral symbol 14 corresponding to the central symbol 14*a* hit with the projectile 22**.

When the player completes his/her turn with the projectile 22, by either cleanly striking each of his/her central symbols **14*a* or by missing on a toss of the projectile 22, that player receives a number of symbol cards 14*b*, each containing one of the symbols 14 of the periphery 12 and symbols 14a of the central area. Accordingly, a total of 36 cards 14b are provided, and a player assigned a total of six peripheral symbols 14 may or may not receive any cards 14b which correspond to the symbols 14 of his/her peripheral area, much less correspond to any central symbols 14a which may have been struck during tosses of the projectile 22; this particular part of the present game provides an element of chance to overcome the pure physical skill required to toss the projectile 22 successfully. Assuming that a player does receive one or more cards 14b corresponding to the central symbols 14a successfully struck with the projectile 22, the marker(s) 22 placed upon the corresponding peripheral symbol(s) 14 of that player are left on the appropriate symbols, while marker(s) 22 which had been placed upon symbols 14 which are not matched by card(s) 14b, are removed from the symbols 14. Matching cards 14b are left upon the symbols 14 to which they match, while any non-matching cards 14b** are returned to the master deck and reshuffled between each player's turn. Play continues in the above manner, with the projectile being passed clockwise to each successive player in turn.

In the event that a player tosses the projectile 22 inaccurately and the projectile 22 lands at least partially upon another of that same player's symbols 14a, then the player ends his/her turn and the projectile is passed to the next successive player. However, the basic rule governing the tossing of the projectile 22, is that any symbol 14a (no matter which player to whom it has been assigned) which the projectile 22 lands upon or contacts, results in the player assigned that symbol 14/14a being given a matching card 14b from the tossing player's (or master) collection. The second player may review the tossing player's cards and select the one(s) which match the symbol(s) 14a struck by the tossing player's projectile, and then return the remaining card(s) to the player who made the errant toss. In the event that the tossing player has no cards which match, then the second player receives the appropriate matching card(s) from the master deck. The matching card(s) is/are displayed face Up adjacent the appropriate matching symbol(s), and an appropriate marker(s) is/are placed upon the matched peripheral symbol(s) 14 of that player, Thus, whether the tossing player has received any card(s) for accurate toss(es) or not, at least one symbol card 14b must be provided for each projectile toss, whether to the tossing player (in the event of an accurate toss) or to another player(s) in the event of a toss which lands upon one or more other player's assigned symbols 14a. While there is no guarantee that the tossing player will receive a matching card(s) in the event of accurate tosses (the player will only receive a number of cards equal to the number of accurate tosses), each other player will receive a matching card in the case of errant tosses which land upon that other player's central symbols 14a.

Figure 2:
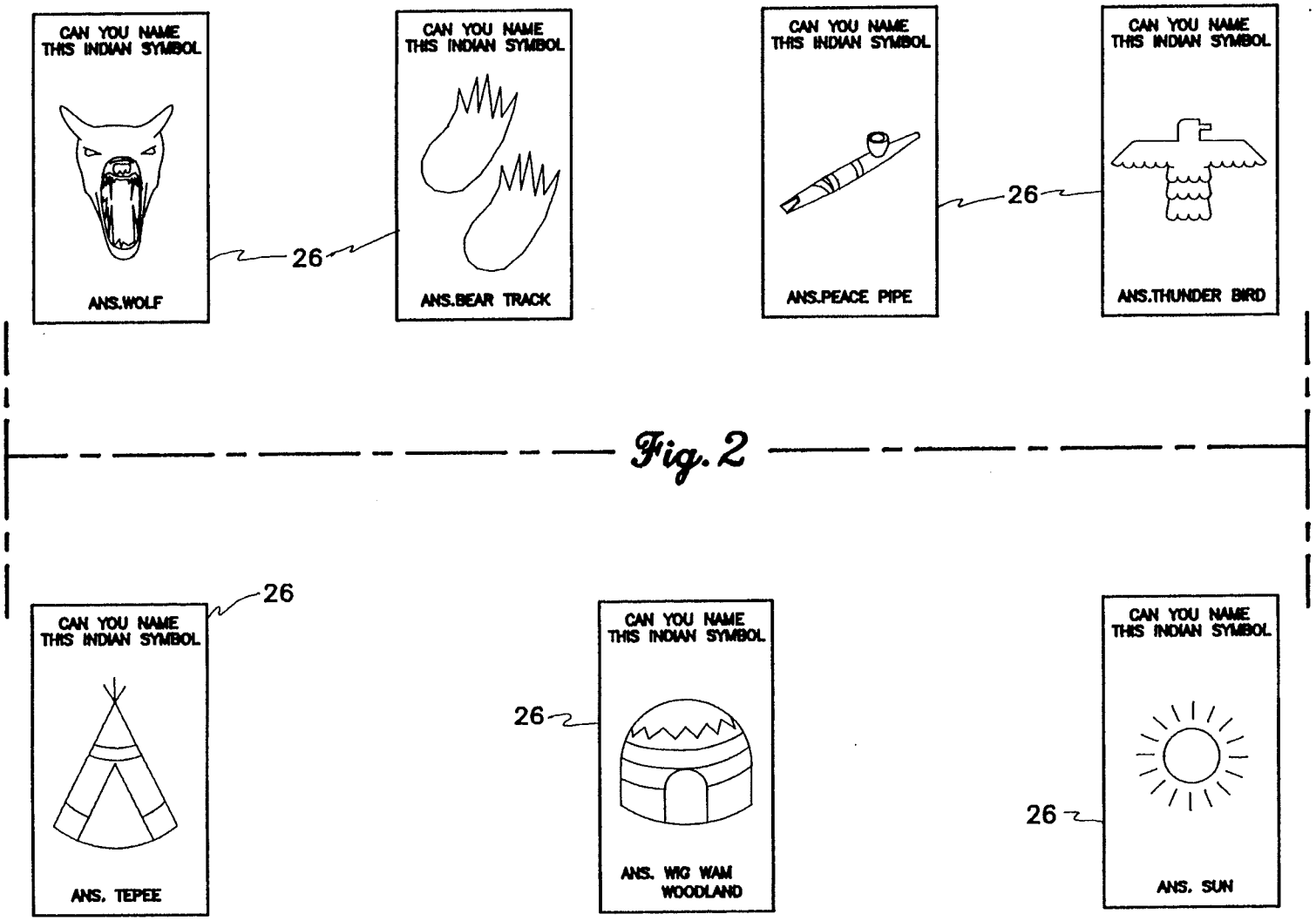
FIG. 2 is a plan view of the faces of the various cards used in the present game to challenge the knowledge of the players.

As the game progresses, it will be evident that each player will have fewer and fewer peripheral symbols 14 remaining to match with an appropriate card 14b. Eventually, one or more of the players will reach a point where they each need only one more matching card 14b in order to complete their set of cards 14b and symbols 20 for each of their assigned peripheral symbols 14, and thus win the game. In order to prevent a player from winning the game, another player may ask the first player a trivia question for each symbol card 14b acquired during the first player's turn. If the first player responds incorrectly, then the symbol card 14b is returned to the master deck. However, if the first player responds correctly, then the symbol card may be retained and a match sought. The same rules for making a match explained above, also apply here. i.e., even if the player receives such a symbol card 14b according to the rules of play (successfully tossing the projectile 22 and, in the case of the end game, successfully responding to a trivia question), that card must still match the last remaining peripheral symbol 14 for the player to win. A non-matching card is returned to the master deck and reshuffled at the end of the turn, as above. Examples of the trivia cards 26 are shown in FIG. 2. It will be noted that, while these trivia cards do not necessarily match some of the symbols 14 and 14a, they may or may not match, as they serve a different purpose. Further trivia questions are listed in the table immediately below, with the correct answers underlined. Some are multiple choice, while others are open.

TABLE 1

LIST OF TRIVIA QUESTIONS AND ANSWERS

1. Who was Chief Joseph's father?
   Old Joseph
2. Name the Indian who was the guest of Thomas Jefferson's father on his journeys to and from Williamsburg?
   a. Tonto b. Outacite c. Ocar
3. How long did the Nez Perce Retreat last?
   a. 108 days b. 700 days c. 25 days
4. In what states are the Black Hills located?
   South Dakota and Wyoming
5. When did the Nez Perce Retreat begin?
   a. June 1680 b. June 1877 c. June 1860
6. Where is the Nanticoke Lenni-Lenape Indian Tribe located?
   New Jersey
7. Did Indians believe in embalming?
   No
8. How many people comprised the Nez Perces entire Tribe in 1877?
   a. 10,000 b. 3,600 c. 100

The above table provides a further intellectual challenge to the players of the present game, in addition to the physical skill and chance means described above. Accordingly, the successful player of the present game must have well developed physical skills providing for the accurate tossing of the projectile 22, and also possess knowledge relating to native American customs and lore, as well as achieving at least some amount of luck in the drawing of the proper symbol cards 14b to match the symbols 14 assigned to him or her. The present game thus does not preclude success for a less skilled and/or knowledgeable player, as the chance means provide for matching of symbol cards 14b with the appropriate symbols 14 of the player tend to even the abilities of different players. Nonetheless, the more knowledgeable and skilled player is more likely to be successful in the play of the present game, due to the requirement of a combination of luck, skill, and knowledge in the play of the present game.

It is to be understood that the present invention is not limited to the sole embodiment described above, but encompasses any and all embodiments within the scope of the following claims.

I claim:

1. A board game incorporating native American symbols and knowledge, comprising:

a game board having a peripheral first plurality of native American symbols, and a second plurality of like and matching native American symbols disposed in a central area within said peripheral first plurality of native American symbols, with said peripheral first plurality of native American symbols being divided into a series of groups;

a plurality of position markers;

a projectile for use an the play of said board game, said projectile having means for selecting one of said native American symbols disposed on said central area when said projectile is thrown toward said central area and strikes one of said native American symbols;

chance means for use in the play of said board game;

a plurality of native American symbol cards matching said symbols of said first plurality and said second plurality; and a plurality of trivia cards relating to native American subject matter, for use in the play of said board game.

2. The board game of claim 1 wherein:

said peripheral first plurality of native American symbols is substantially circular.

3. The board game of claim 1 wherein:

said peripheral first plurality of native American symbols, said second plurality of like and matching native American symbols, and said plurality of native American symbol cards marching said symbols of said first plurality and said second plurality each comprise thirty six symbols.

4. The board game of claim 3 wherein:

said peripheral first plurality of native American symbols is divided into six groups with each of said groups including six of said native American symbols.

5. The board game of claim 3 wherein:

said second plurality of like and matching native American symbols comprises a substantially square matrix having six said symbols along each side.

6. The board game of claim 1 wherein:

said chance means comprises a single cubical die having six faces numbered one through six.

7. The board game of claim 1 wherein:

said projectile comprises a dart having a suction cup disposed upon a forward end thereof.

8. A method of playing a board game incorporating native American symbols and knowledge, comprising the following steps:

providing a game board having a peripheral first plurality of native American symbols, and a second plurality of like and matching native American symbols disposed in a central area within the peripheral first plurality of native American symbols, with the peripheral first, plurality of native American symbols being divided into a series of groups;

further providing a plurality of position markers, a projectile for use in the play of said board game, chance means for use in the play of said board game, and a plurality of native American symbol cards matching said symbols of the first plurality and the second plurality;

choosing at least one of the groups of symbols for use by each player;

determining a first player by using the chance means, with the order of play of second and subsequent players proceeding clockwise around the peripheral first plurality of native American symbols of the game board;

tossing a projectile and attempting to strike one of the second plurality of like and matching native American symbols of the central area of the game board corresponding to a symbol of that player's at least one group of symbols, without striking any others of the second plurality of like and matching native American symbols, with the player continuing until a miss occurs;

placing position markers upon the peripheral first plurality of native American symbols corresponding to the second plurality of like and matching native American symbols of the central area of the game board struck by the projectile;

receiving a number of native American symbol cards corresponding to the number of the second plurality of like and matching native American symbols of the central area struck by the projectile;

comparing the native American symbol cards received to that player's group of peripheral first plurality of native American symbols, retaining any of the native American symbol cards matching any of the symbols of that player's group, and surrendering any remaining cards to other players for the matching of the remaining cards to the symbols of the other players groups; and, continuing in the above manner with each player playing in clockwise turn, until one player has matched each of the symbols of that player's group with one of the native American symbol cards and thereby determining the winner of the game.

9. The method of play of claim 8 including:

choosing more than one of the groups of symbols for use by each player.

10. The method of play of claim 8 including:

providing a plurality of trivia cards relating to native American subject matter for use in the play of the board game;

requiring a player to respond to a Question contained on one of the trivia cards, when that player has matched all, but one of the symbols of that player's at least one group with native American symbol cards, and proceeding according to one of the two following steps;

(1) allowing that player to receive a further native American symbol card when the trivia question is responded to correctly, with that player attempting to match the native American symbol card to the one remaining symbol of that player's at least one group and returning any non-matching cards to a master deck: or, (2) returning any native American symbol cards received to a master deck when the trivia question is responded to incorrectly.

* * * * *